US005145225A

United States Patent [19]

Muller et al.

[11] Patent Number: 5,145,225

[45] Date of Patent: Sep. 8, 1992

[54] CARPET STRETCHER

[76] Inventors: George M. Muller, 11 Verdun St., Tingalpa, Queensland 4173; Gordon H. Stuart, 10 Sterculia Avenue, Holland Park, Queensland, 4121, both of Australia

[21] Appl. No.: 646,799

[22] PCT Filed: Jul. 27, 1989

[86] PCT No.: PCT/AU89/00317

§ 371 Date: Mar. 18, 1991

§ 102(e) Date: Mar. 18, 1991

[87] PCT Pub. No.: WO90/00877

PCT Pub. Date: Feb. 8, 1990

[30] Foreign Application Priority Data

Jul. 27, 1988 [AU] Australia ..... PI9488

[51] Int. Cl.[5] ..... A47G 27/04

[52] U.S. Cl. ..... 294/8.6; 254/201

[58] Field of Search ..... 294/8.6; 254/200, 201, 254/228

[56] References Cited

U.S. PATENT DOCUMENTS

| | | | |
|---|---|---|---|
| 3,951,382 | 4/1976 | Asbury | 254/201 |
| 3,977,651 | 8/1976 | Chamberlain | 254/201 |
| 4,042,211 | 8/1977 | Hammond et al. | 254/201 |
| 4,084,787 | 4/1978 | Kowalczyk | 254/201 |
| 4,119,338 | 10/1978 | Agcaoilli | 294/8.6 |
| 4,361,311 | 11/1982 | Koroyasu et al. | 254/200 |

FOREIGN PATENT DOCUMENTS

| | | | |
|---|---|---|---|
| 826869 | 11/1969 | Canada | 294/8.6 |

*Primary Examiner*—Margaret A. Focarino
*Assistant Examiner*—Dean J. Kramer
*Attorney, Agent, or Firm*—Price, Gess & Ubell

[57] ABSTRACT

A carpet stretcher assembly is provided having a retractable carpet engaging head that can be pneumatically driven by a cylinder assembly. The carpet engaging head is connected to the pneumatic cylinder assembly by a flexible connection whereby the carpet engaging head can automatically be moved to an elevated position relative to a carpet being stretched when it is retracted by the pneumatic cylinder assembly.

11 Claims, 7 Drawing Sheets

CARPET STRETCHER

TECHNICAL FIELD OF THE INVENTION

THIS INVENTION relates to a carpet stretcher and particularly to a carpet stretcher which has greater versatility and is easier to operate than carpet stretchers of the prior art.

BACKGROUND ART

When a carpet is installed, as for example a wall-to-wall carpet, it is stretched by the carpet installer with the aid of a carpet stretcher. The carpet is usually stretched to engage a tackless strip. The tackless strip is usually fixed to a floor about the perimeter of a room at a position closely spaced from the walls. If the carpet is not stretched adequately and uniformly, undesirable effects can occur. If a carpet is overstretched joins can separate leaving unsightly delineations between sections of carpet. If a carpet is understretched it can bubble and/or ruck becoming unsightly and dangerous.

The stretching characteristics of carpets are complex and variable. For example, tufted carpets should be stretched equally along their length and width, Axminster carpets have more stretch in the length, so they should be stretched lengthwise first, woven carpets should be stretched widthwise first, in most cases Velvet and Wilton weaves should be stretched widthwise first.

Carpet manufactures recommend that jute-backed tufted carpets be stretched "drum-tight". The amount of stretch needed for a polypropylene backed carpet is usually calculated as one and a half percent of the carpet length and width. The amount of stretching required is further complicated for jute-backed carpeting of lengths longer than 7 meters because the carpet tends to drag against the underlay and make the stretch "feel" tighter than it really is. In addition the amount of stretch required for a particular type of carpet varies between carpets produced by different manufacturers.

As a consequence a carpet installer is usually a highly experienced well practiced individual who is capable of making a qualitative judgement whether or not he has stretched a carpet properly. If the judgement is incorrect the carpet usually requires restretching. If the carpet is overstretched and begins to contract after settling the carpet in question might have to be replaced at the expense of the carpet installer There has been little attempt in the past to provide a carpet stretcher which could be used in a variety of applications and also provide a quantitative measure of carpet tension. Prior art carpet stretchers were either limited to operation by highly skilled carpet installers who relied on their experience to "feel" the amount of stretch. Alternatively, prior art carpet stretchers were too complex in construction.

The first generic carpet stretcher used to a large degree was the "knee kicker". The knee kicker had an elongate body and employed a carpet engaging head at one end and a knee pad at the other end. The carpet installer applied an impulse via his knee to the knee pad whilst the head was engaged with the carpet. The installer had to make a qualitative judgement of the amount of stretch in a carpet and chronic knee injuries were frequent. Examples of knee kickers are given in U.S. Pat. Nos. 2,882,642 and 2,631,403.

To avoid injuries and the attendant compensation payments the "power stretcher" was developed. The power stretcher employs a carpet engaging head and a manually operable lever to extend the carpet engaging head and can be used to push from or pull to a stationary support. For example in U.S. Pat. Nos. 3,784,078 and 3,599,936 power stretchers are described which employ telescopic attachments. The telescopic attachments have a foot which in use is placed against a wall or other support near a fixed edge of a carpet being installed. The carpet engaging head is then engaged with the carpet adjacent an opposite edge of the carpet and the lever is pushed into its locked down position thereby extending the carpet engaging head a full length to stretch the carpet toward and into engagement with a fixed tackless strip. Some carpet installers recommend a plurality of full length extensions at each of a plurality of spaced locations along the carpet edge. Other installers use a larger number of smaller extensions at each point along an edge. The amount of stretch is determined as a qualitative judgement by the carpet installer. Another major problem with this form of power stretcher arises from the need to use telescopic attachments, particularly in large rooms, the set up time can be long and it is usually difficult to move the assembled stretcher.

Another power stretcher also employs a manually operated lever but does not use a telescopic attachment. As shown in U.S. Pat. Nos. 3,001,762, 3,980,274 and 3,963,216 a face plate can be used to fit in the space between the tackless strip and the wall. The tackless strip therefore provides a stationary support. On operation of the lever the carpet engaging head stretches the carpet to move the carpet edge toward and into engagement with the tackless strip.

In the aforementioned cases the lever operated power stretcher can only provide a qualitative measure of stretch. In addition the stretch is usually uneven across the carpet. The location of the lever and the requirement for manual operation necessitates the carpet installer to be on hand to operate the lever and does not permit the carpet installer to physically disturb remote areas of the carpet during stretching so as to more evenly distribute tension. It would be desirable for the carpet installer to walk over or scuff his feet on the carpet at locations remote from the carpet engaging head during the stretching operation. This would assist in distributing the tension. This is not possible with the aforementioned power stretchers.

The aforementioned carpet stretchers all operate on carpet where one edge is fixed, usually to a tackless strip. In the examples given a single carpet engaging head is employed. There are however, carpet stretchers which employ multiple heads. In U.S. Pat. Nos. 3,311,347 and 4,008,879 opposed heads are mounted on a ladder network and can be forced apart. The heads are usually located on opposite sides of a room to drive opposed carpet edges simultaneously onto opposed tackless strips. These arrangements provide more uniform tension than the single head stretcher because they operate on both edges. The ladder network can become very cumbersome in large rooms. These stretchers have found little application. Multiple head carpet stretchers are also used to force the edges of adjacent carpets together to form a join. One example is given in U.S. Pat. No. 4,394,004. This carpet stretcher employs two opposed heads one being a fixed head and the other a movable head. The movable head is located on a threaded stub which on rotation moves the movable toward or away from the fixed head. The rotation of the stub provides some quantitative measure of the applied tension However, the "feel" of the carpet installer still determines the limit of stretch for any one application. Once this is accomplished of course a corresponding number of rotations of the stub can be applied along the join.

Other attempts have been made to quantify the amount of stretch applied to a carpet but these have not found ready acceptance in the trade. For example in U.S. Pat. No. 1,929,837 a manually operated lever is used to rotate a pinion which meshes in a rack. The rack has a carpet engaging head at one end. While the amount of head extension can be regulated and reproduced along a carpet edge, the amount of stretch must still be determined by "feel".

A similar situation arises with power stretchers which have a variable extension mechanism to provide preselected extension of the carpet engaging head. In U.S. Pat. Nos. 3,693,936 and 3,917,225 a manually operated lever is operable at preselected extension of the carpet engaging head. The initial setting of the extension must be determined qualitatively by "feel".

In U.S. Pat. No. 3,311,347 a set of bathroom scales are incorporated in the carpet stretcher to measure compression force between opposed carpet engaging heads. While this arrangement provides a quantitative measure of the compression force between the two heads the carpet stretcher is cumbersome and the measuring means is not readily adaptable to a single head carpet stretcher.

OUTLINE OF THE INVENTION

From the foregoing and having cognizance with the problems of the prior art it is an object of the present invention to overcome or alleviate at least some of the problems.

In one aspect therefore the present invention resides broadly in a carpet stretcher including a hydraulic or pneumatic cylinder assembly, a retractable carpet engaging head connected to the cylinder assembly, and control means for controlling flow of fluid into or out of the cylinder assembly in order to extend or retract the carpet engaging head.

In another aspect the present invention resides in a carpet stretcher comprising a frame, a carpet engaging head, a hydraulic or pneumatic cylinder assembly supported by the frame, said cylinder assembly having a cylinder, a piston within the cylinder and a piston rod connected to the piston and extending from the cylinder, control means for supplying control fluid to the cylinder assembly, connecting means operatively associated with the carpet engaging head and the piston rod to enable selective movement of the carpet engaging head between an extended position and an elevated retracted position in response to the operation of said control means.

In a further aspect the invention resides in a carpet stretching kit including a carpet stretcher and a plurality of accessories, the carpet stretcher including a hydraulic or pneumatic cylinder assembly, a retractable carpet engaging head connected to the cylinder assembly, and control means for controlling flow of fluid into or out of the cylinder assembly in order to extend or retract the carpet engaging head, and accessory attachment means to enable a said attachment to be removably attached to the carpet stretcher. The accessories can include an accessory selected from the following:

a) an extension having one end securable to the attachment means and operatively so; secured has a free end remote from the attachment means whereby the carpet engaging head can retract in a direction away from the free end.

b) an extension having one end securable to the attachment means and when operatively so secured has a free end remote from the attachment means whereby the carpet engaging head can retract in a direction toward the free end.

c) an auxiliary carpet engaging head securable to the attachment means, and when so secured to in use, act in opposition to or in unison with the retractable carpet engaging head.

The carpet engaging head is preferably a conventional carpet engaging head of the type employing a plate having a plurality of angled prongs or naps extending from the plate. Preferably the plate is mounted inside a housing. Advantageously, the plate is adjustably mounted within the housing to facilitate extension and retraction of the prongs from the housing. A travel control means can be employed to enable the length of travel of the carpet engaging head to be preset.

The cylinder assembly is preferably mounted on a frame the frame is preferably elongate and can be constructed from any suitable material. Preferably the frame is constructed of metal or rigid plastics. The frame preferably includes a handle located adjacent a handle end. The frame can include accessory attachment means at one or each end. The frame preferably includes inner conduits through which a control fluid can flow to the cylinder assembly The cylinder assembly can be a single acting or double acting cylinder assembly. Where a double acting pneumatic cylinder assembly is employed it is preferably for the control means to maintain a constant pressure on the piston rod side of the piston. Where a pneumatic cylinder is employed the control means preferably includes a pressure regulator which can be used to maintain the constant pressure. The pressure regulator can be adapted to vent air from the piston rod side of the piston when the pressure exceeds a predetermined pressure. The pressure regulator can be operable to preset the predetermined pressure at any one of a plurality of pressures.

The control means preferably includes a valve. The valve is preferably located on the frame adjacent the handle to facilitate single handed operation of the carpet stretcher. Preferably the valve is biased to a closed position preventing the flow of control fluid to the cylinder assembly. The bias is preferably provided by a spring preferably a coil spring is employed.

The valve preferably has a number of operative control positions which direct control fluid into the cylinder assembly to initiate different responses from the carpet engaging head. The positions can include an extension position, a retraction position, a neutral position, and a reciprocating position. Advantageously, the valve can be locked temporarily in at least one of the operative positions. Advantageously, the valve can be locked in the neutral position. Movement of the valve to the extension position can initiate an extension of the carpet engaging head. Movement of the valve to the retraction position can initiate a retraction of the carpet engaging head. Movement of the valve to the neutral position can stop the carpet engaging head at any position of extension or retraction. Movement of the valve to the reciprocating position can initiate a full cyclic reciprocation of the carpet engaging head between retracted and extended positions. The valve is preferably a spool valve and the spool of the valve can be housed in a bore in the frame. The biasing spring can be located inside the bore to bias the spool against a shoulder in the bore.

The spool preferably has an extension which extends from the frame to form a manually operable push button to enable an operator to operate the valve. The extension can include at least one shoulder engagable with a stop on the frame to lock the spool at any one of the control positions.

The control means can also include a pressure regulator and pressure gauge to monitor and control the pressure of control fluid applied to the cylinder assembly. Thus, the amount of force applied during extension of the carpet engaging head can be controlled and monitored. The amount of stretch applied to a carpet can be calibrated in terms of a pressure reading on a pressure gauge and thereby provide a quantitative measure of the amount of stretch.

The connecting means is preferably designed so the carpet engaging head can be moved relative to the piston rod. Advantageously, the connecting means provides a flexible connection between the carpet engaging head and the piston rod. Preferably the connecting means includes an arm having one end mounted to the piston rod and the other end mounted to the carpet engaging head. The connecting means can include a pivotal linkage to enable movement of the engaging head relative to the piston rod. The linkage can be connected between the arm and the carpet engaging head. Advantageously, the linkage operates automatically to elevate the carpet engaging head during retraction of the head.

Where a pivotal linkage is employed to connect the arm to the carpet engaging head a stabilizing means is preferably employed to restrict the movement of the carpet engaging head relative to the piston rod. The stabilizing means can restrict movement of the carpet engaging head in use to a vertical movement.

The stabilizing means can include a push plate located between the piston rod and the carpet engaging head. The push plate can be positioned transversely of the piston rod longitudinal axis and can abut the carpet engaging head between the piston rod and the carpet engaging head. The push plate is preferably mounted on one or more guides which move in guideways on the frame. Advantageously, during retraction, the push plate assists the linkage means to elevate the carpet engaging head to the retracted position. The push plate can include a locating means for the arm.

Preferably during operation of the carpet stretcher there is lost motion between the arm and the push plate. The lost motion effecting elevation or lowering of the carpet engaging head relative to the push plate as the piston rod extends or retracts. Advantageously, the carpet engaging head slides on the push plate as the carpet engaging head is elevated or lowered.

The carpet stretcher is most advantageous as a carpet stretcher of the type which can be operated independently of stationary supports such as the walls of a room by suitable accessories the carpet stretcher can be used with a stationary support. As mentioned above it is preferable to provide the frame with accessory attachment means at each end of the frame to an accessory can be secured. The accessory can comprise a face plate extension adapted for location behind a tackless strip so the carpet stretcher can stretch carpet towards say an adjacent wall to engage a carpet edge with the tackless strip. The accessory can be a telescopic extension to enable the carpet stretcher to push from say a far wall. Alternatively other accessories may be employed to advantageous effect. For example, a frame including a fixed carpet engaging head may be secured opposite the head of the carpet stretcher. With this arrangement carpet edges may be pushed together or driven apart. The two heads may be arranged to pull carpet between the heads and the amount of tension in a carpet may be measured. For example, after a carpet has been installed the pressure required to cause a carpet to ruck between the heads could be read directly from a pressure gauge calibrated to measure whether the carpet has been correctly tensioned. Thus, a quantitative measure of tension in a carpet can be made at any location.

BRIEF DESCRIPTION OF THE DRAWINGS

The present invention will be better understood by considering the preferred embodiments described below with reference to the drawings and wherein.

METHOD OF PERFORMANCE

Figure 1:
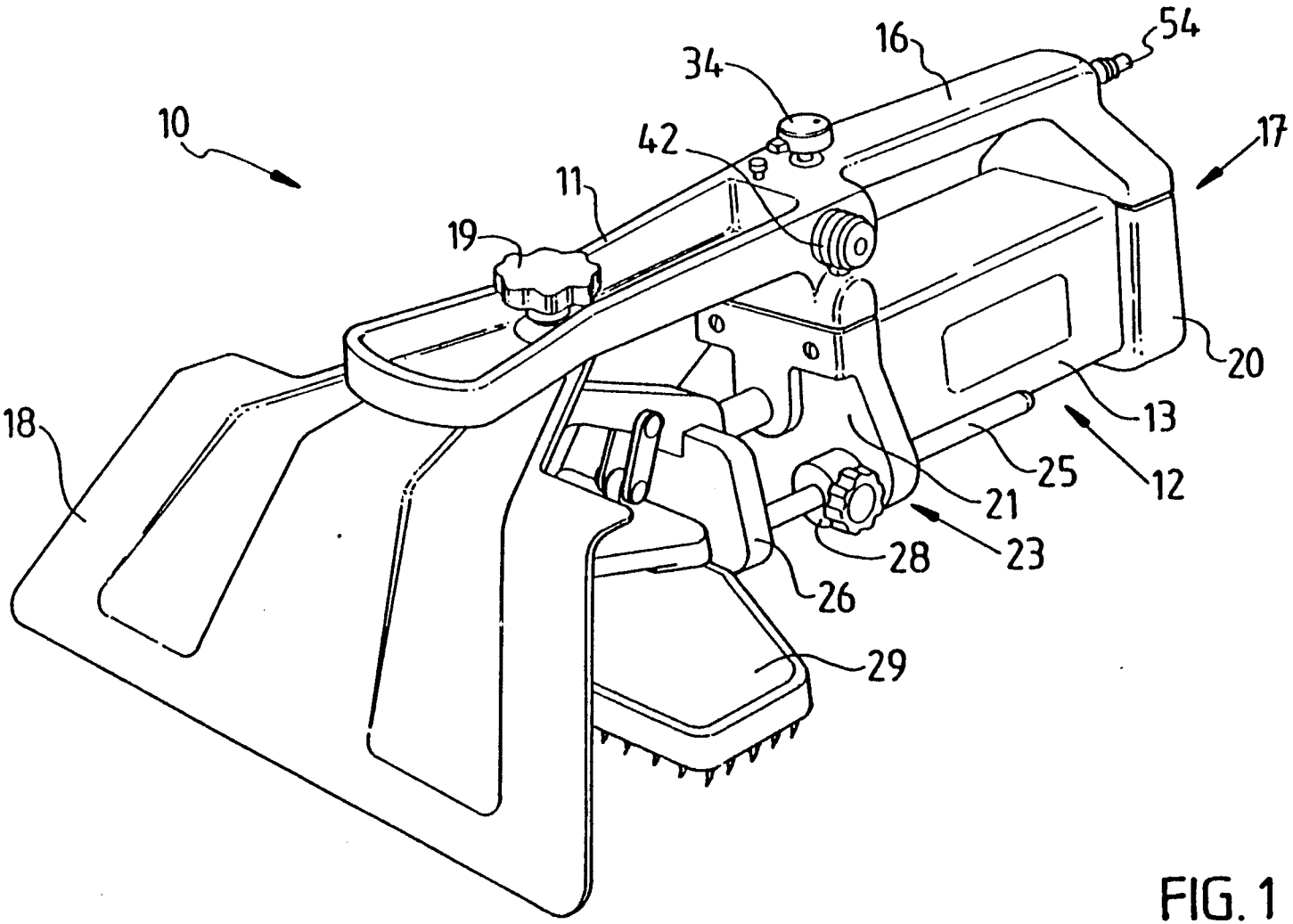
FIGS. 1 and 2 are perspective views illustrating a carpet stretcher according to the present invention.
Figure 2:
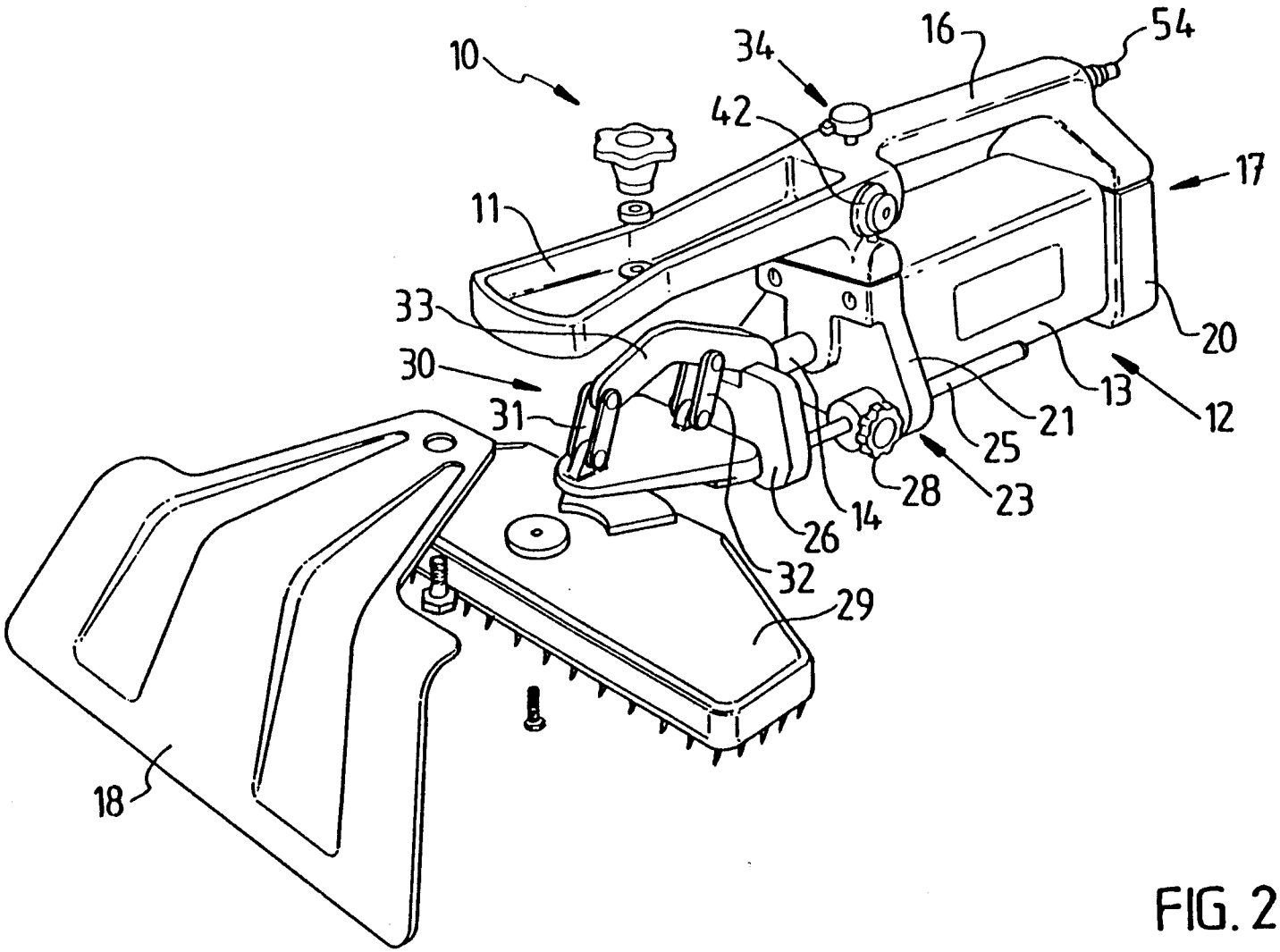
Figure 3:
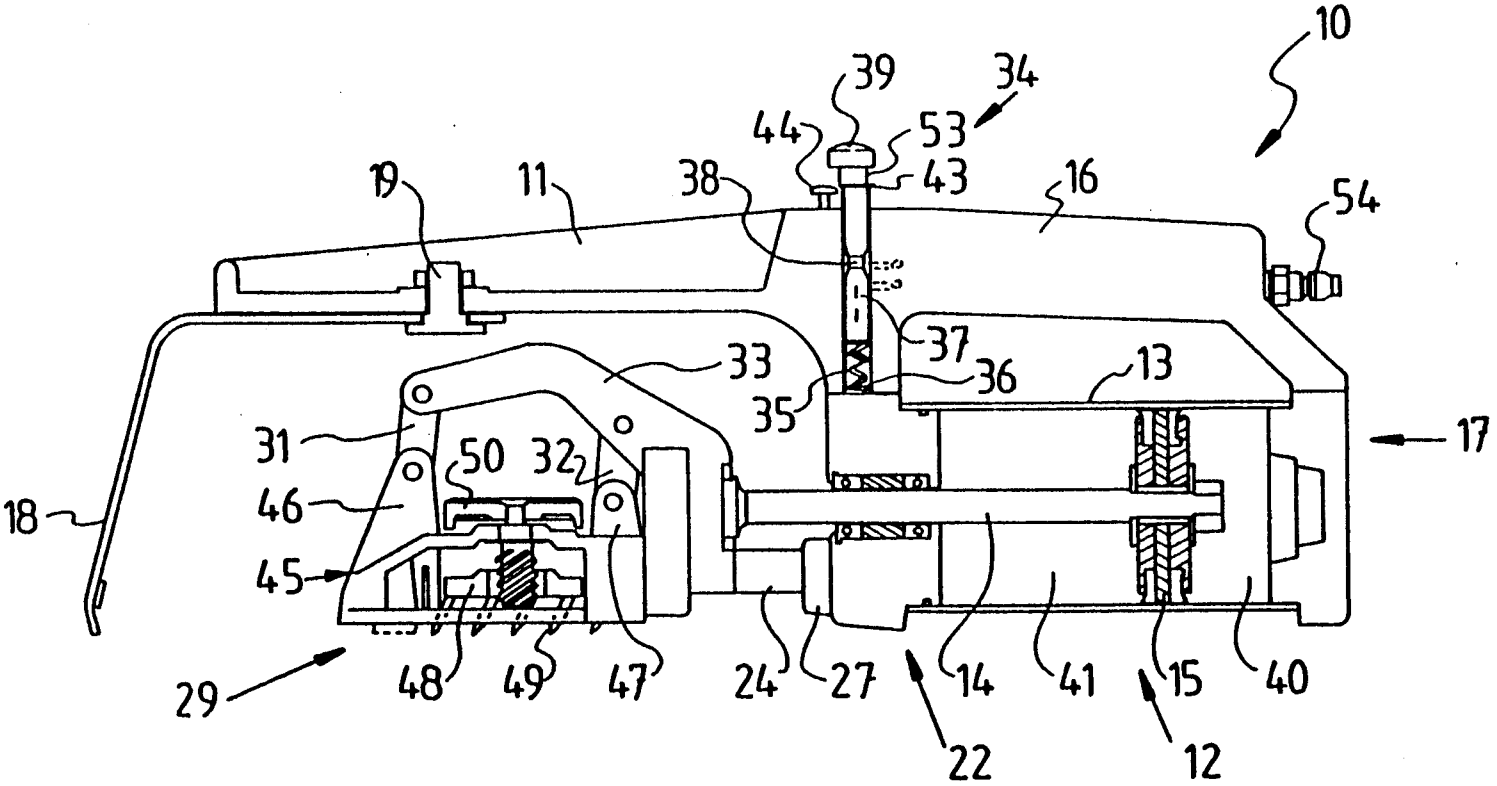
FIG. 3 is a longitudinal cross-section through a carpet stretcher of the type illustrated in FIGS. 1 and 2.

Referring to the drawings and initially to FIGS. 1 to 3 there is illustrated a carpet stretcher 10 according to the invention. The carpet stretcher 10 includes an elongate frame 11 of general F-shape in side view. In this case the control fluid is compressed air and the frame supports a double acting pneumatic cylinder assembly 12 which can be used to extend or retract a carpet engaging head 29. The pneumatic cylinder assembly 12 includes a cylinder 13, comprising drive chamber 40 and return chamber 41, a piston rod 14 and a piston 15 (see FIG. 3) located within the cylinder. The cylinder 13 is spaced from a handle 16. Opposite the handle end 17 is mounted an accessory which in this case is a face plate 18. The face plate 18 is removably mounted to the frame 11 by a nut and bolt 19. The nut and bolt 19 may be released to enable detachment of the face plate 18 from the frame 11. Other accessories may be secured to the frame in place of face plate 18 (see for example FIG. 13).

As can be seen, the cylinder assembly 12 is supported between two frame members 20 and 21 of the frame 11. The frame member 21 includes transversely spaced guideways 22 and 23 (one of which is concealed). Guide rods 24 and 25 slide through the respective guideways 22 and 23. The guide rods 24 and 25 are secured at transversely spaced locations to a push plate 26. Travel control means in the form of guide rod stops 27 and 28 can be releasably secured to the guide rods 24 and 25 along their length to vary the length of travel of the carpet engaging head 29.

A flexible connecting means in the form of a parallelogram linkage 30 comprising pivoting link pairs 31 and 32 connect the carpet engaging head 29 to a push/pull arm 33. The push/pull arm 33 is rigidly secured to the piston rod 14.

As can be seen more clearly in FIG. 3 the carpet stretcher 10 of this embodiment is controlled by a manually operable spool valve 34. The spool valve 4 is located in a bore 35 in frame 11 and can be depressed against biasing spring 36 and automatically released when a depressing force is removed. The spool 34 includes a waisted portion 38 and an extension which is formed as a push-button 39. When the push button 39 is fully depressed the waisted portion of the spool aligns with a control fluid conduit (not shown) to connect the drive chamber 40 of pneumatic cylinder assembly 12 to a source of compressed air (not shown). The source of compressed air would be connected to the carpet stretcher 10 via a flexible hose connected to nozzle 54.

The source of compressed air might be a compressor and the pressure applied to the drive chamber 40 could be varied by appropriate control of the compressor. Thus a quantitative measure of force applied to a carpet being stretched can be estimated on the basis of the applied pressure.

When the push button is released the waisted portion 38 is positioned as illustrated in FIG. 3 to vent the drive chamber 40 to atmosphere. In order to retract the carpet engaging head 29, the control fluid is constantly supplied to the return chamber 41 at a controlled pressure via a regulator 42 (see FIG. 1). The regulator used in this embodiment is of the relieving type and is preferably of the Norgren series R06 manufactured by Norgren of Shipstontown Stour, Warwickshire, England. This particular regulator can accommodate a gauge (not shown) in order to control the return chamber pressure.

Thus a constant retraction pressure is provided in the return chamber 41 independent of the pressure in the drive chamber 40. The regulator 42 enables the return chamber 41 to vent air as the pressure in the return chamber increases during an extension.

When the spool is in the position shown in FIG. 3 the drive chamber is at atmospheric pressure and the return chamber is at a constant, say 4 P.S.I, pressure above atmospheric pressure thus causing automatic retraction of the piston 15 and hence the carpet engaging head 29.

The push button 39 includes a shoulder 43 which can engage a stop 44 on frame 11 following depression and rotation of the push button 39. When the shoulder 43 is engaged with the stop 44, the waisted portion 38 of the spool is in a neutral position intermediate the spool fully depressed position and its fully released position.

In the neutral position control fluid is no longer supplied to the drive chamber and the piston stops moving when in use due to resistance of carpet on the carpet engaging head. The push button extension 39 can include an additional shoulder 53 in order to lock the spool 37 in the fully depressed position. Under these circumstances a carpet installer can activate the carpet stretcher to extend and then he may scuff or walk on remote regions of a carpet in order to assist tension distribution during an extension stroke.

In another form, the stop 44 could be in the form of a pivoting catch which locks the spool in a fully depressed position and then responds to full extension of the carpet engaging had to automatically release the spool and initiate complete retraction of the head. This enables the carpet engaging head to reciprocate automatically.

Before considering the operation of the carpet engaging head 29, the head 29 illustrated, is of generally conventional form and as shown in FIG. 3 the head 29 includes a housing 45 on which is rigidly mounted front and rear mounting flanges 46 and 47. The flanges 46 and 47 are pivotally connected to the link pairs 31 and 32. A plate 48 is located within the housing and threadedly engaged with a threaded stub 49. A knob 50 is connected to the threaded stub so that on rotation of the knob, the threaded stub will also rotate to move the plate up or down relative to the housing 45. Angled prongs or naps 51 are rigidly secured to the plate 48 and thus the extent to which the prongs protrude from the housing can be regulated for application of the head to different carpets.

Figure 4:
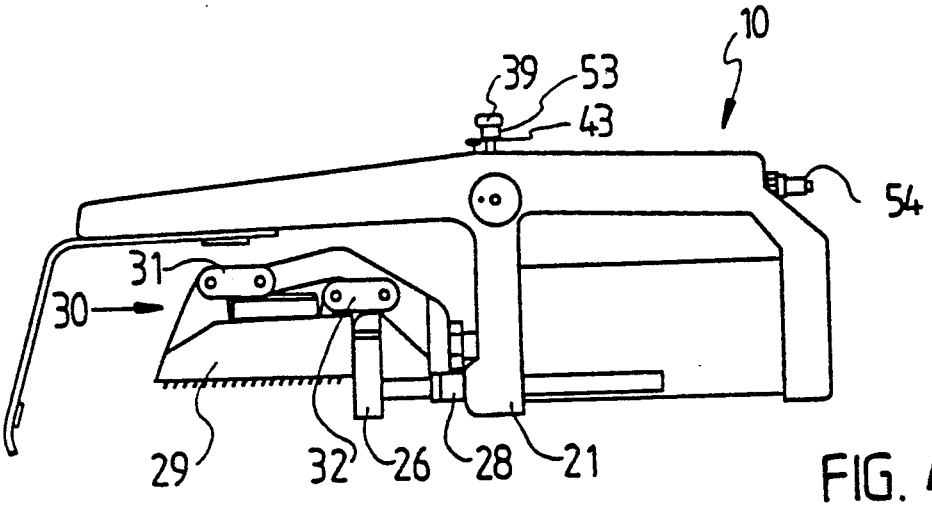
FIGS. 4 to 8 illustrate typical operation of the carpet stretcher of FIGS. 1 to 3.

Referring to FIGS. 4–8 the operation of the carpet stretcher will be described through a full cycle of extension and retraction in order to illustrate the operative relationship between the push/pull arm 33, the push plate 26 and the parallelogram linkage 30. Like numerals have been used to illustrate like features, some numerals have been omitted for clarity as has a hose connection to nozzle 54. In FIG. 4 the carpet engaging head is illustrated in its fully retracted and elevated position. The guide stop 28 is shown abutting against the frame member 21 and the link pairs 31 and 32 are horizontal. The push plate 26 abuts the carpet engaging head 29.

Figure 5:
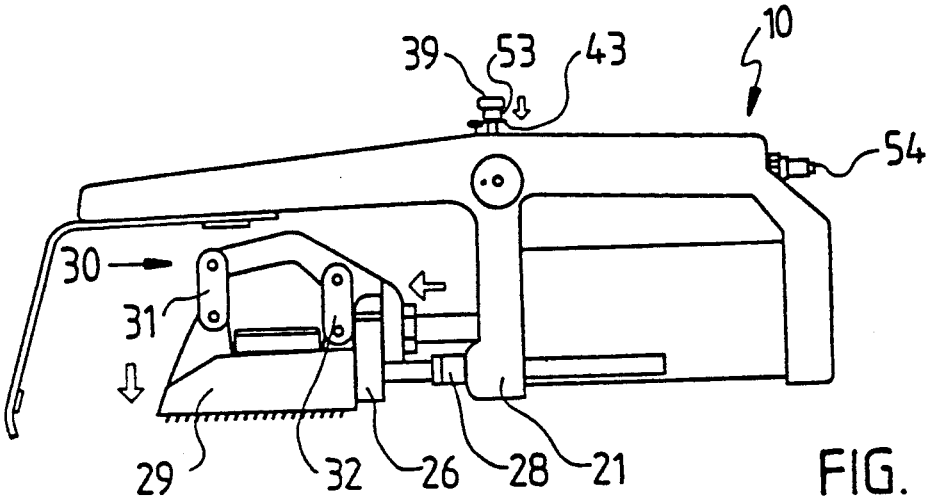

In FIG. 5 the push button 39 has been fully depressed thereby supplying control fluid to the drive chamber 40 of cylinder assembly 12. The piston rod 14 has extended so that side plates 52 on each side of the push/pull arm 33 abut push/plate 26, the side plates 52 are rigidly mounted on either side of push/pull arm 33 to apply force against the push plate 26. In this regard please note that the push plate 26 includes a central vertical slot in which the push/pull arm 33 locates when in the position illustrated in FIGS. 5 and 6 (see FIG. 1). This assists in stabilising the carpet engaging head against rotation during extension.

As can be seen there is initially lost motion between the push plate 26 and the side plates 52 between the commencement of extension as in FIG. 4 and the position as in FIG. 5. In FIG. 5 the side plates 52 have just commenced to transmit the drive force from the cylinder assembly 12 onto the push plate 26. During this lost motion the link pairs 31 and 32 have moved to the vertical thereby vertically lowering the carpet engaging head 29 to its carpet engaging position. In all this time the carpet engaging head 29 has maintained contact with the push plate 26.

Figure 6:
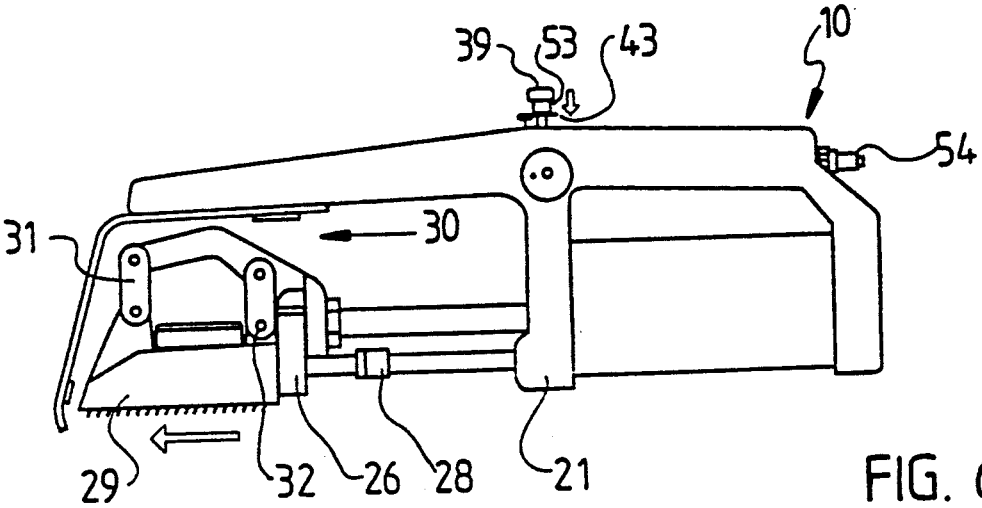

In FIG. 6 the push button 39 is still depressed and the cylinder assembly 12 is shown with the piston rod 14 fully extended and the geometrical relationship between the push/pull arm 33, link pairs 31 and 32, carpet engaging head 29 and push plate 26 is the same as is illustrated in FIG. 5.

The push button 39 can be retained in its fully depressed position and the carpet engaging head 29 will remain at full extension. Alternatively at some stage during the operation described thus far the push button 34 could have been locked in its fully depressed position via shoulder 53 or in the neutral position via shoulder 43.

Figure 7:
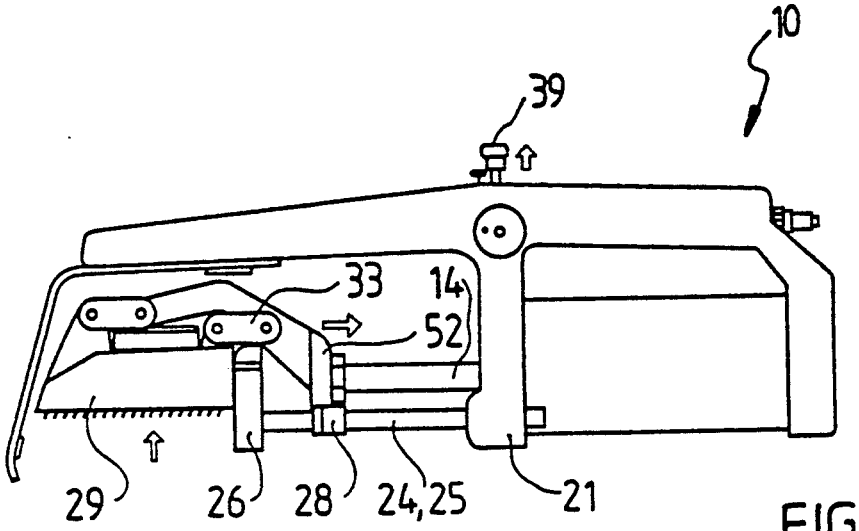

In FIG. 7 the push button 39 is fully released and the push/pull arm 33 and its side plates 52 have retracted the same distance corresponding to the abovementioned lost motion referred to with reference to extension. It is to be noted that the resistance to movement of the guide rods 24 and 25 through their respective guideways is arranged to initially prevent retraction of the push plate 26 as the arm 33 retracts from its fully extended position. This can be achieved in a number of ways, for example, each guideway can include a frictional bearing surface such as a rubber o-ring through which its corresponding guide rod frictionally slides.

As can be seen in FIG. 7 the consequence of retraction of push/pull arm 33 from the push plate 26 is that the carpet engaging head 29 is elevated vertically and the link pairs 31 and 32 return to the horizontal. This correspond- to the elevated retracted position for the carpet engaging head. The retraction force now comes to bear on push plate 26 and overcomes guideway resistance to retract the carpet engaging head 29 until stop 28 abuts against frame member 21 as shown in FIG. 8.

Figure 8:
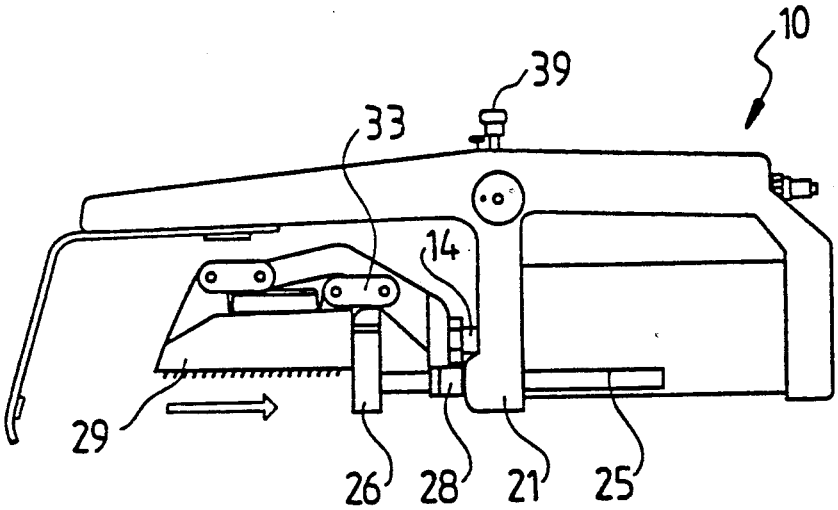

FIG. 8 corresponds to the completion of an extension and retraction cycle and as can be seen FIG. 8 corresponds to the position shown in FIG. 4. The push button 39 can be fully depressed and another cycle will be initiated.

Figure 9:
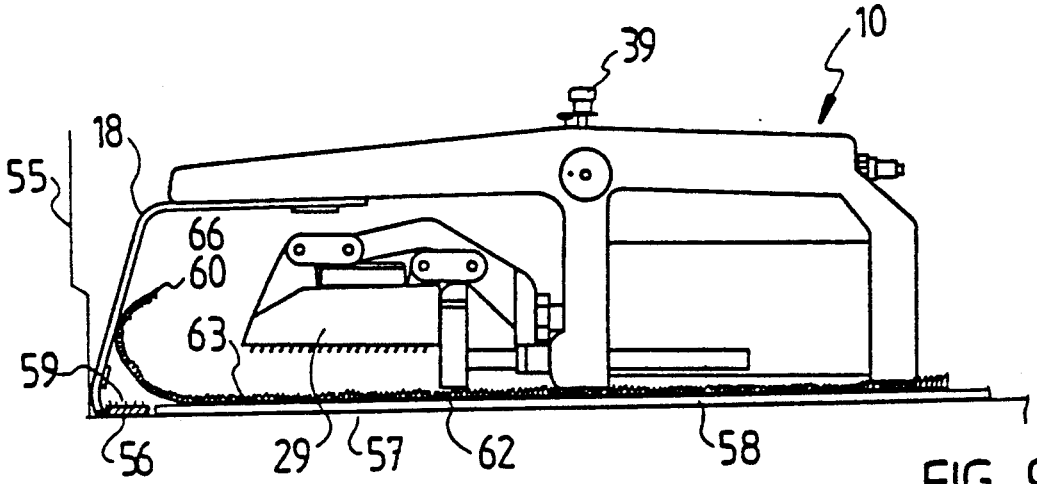
FIGS. 9 to 11 illustrate typical operation of the carpet stretcher of FIGS. 1 to 8 in a carpet laying environment.
Figure 10:
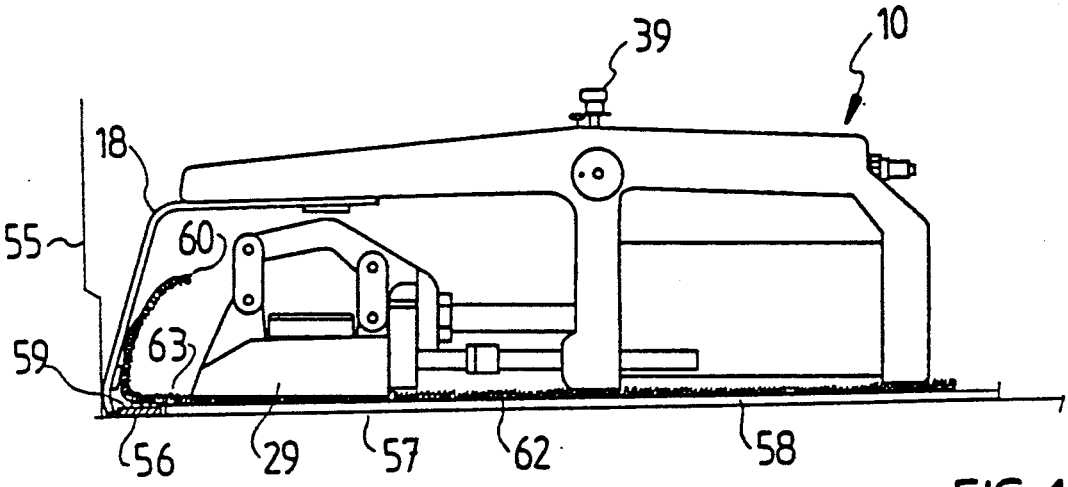
Figure 11:
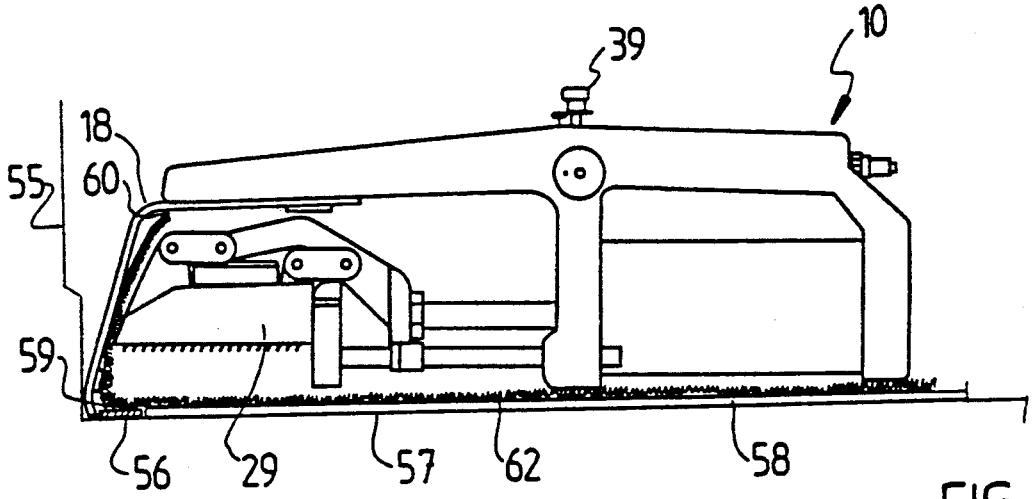

FIGS. 9 to 11 illustrate application of the carpet stretcher of the present invention to laying wall-to-wall carpet in a room. Like numerals have been used to illustrate like features. Prior to stretching the carpet using the present invention the carpet installer will have consulted the manufacturers specifications for the carpet being laid. We assume these specifications have been devised for use with the present invention and they specify a predetermined length of extension and/or a predetermined pressure. The carpet installer adjusts the position of guide stops 27 and 28 to give the specified extension and likewise sets his compressor (not shown) to provide the specified pressure. Under these circumstances the amount of stretch he is going to apply every time he depresses push button 39 is preset and can be quantified without requiring the skills of an experienced carpet installer as was the case in the prior art.

In FIG. 9 a face plate 18 is employed to pull the carpet towards wall 55 of a room. A tackless strip 56 is shown secured to floor 57 at a closely spaced distance from wall 55 Underlay 58 has been laid on the floor 57 inside the tackless strip 56. Carpet 59 has been laid on the underlay and has one edge (not shown) fixed to a tackless strip on the other side of the room. The opposite edge 60 is positioned inside the face plate 18 above the tackless strip 56. The face plate 18 is positioned behind the tackless strip 56. The face plate 18 includes a lug 61 which is positioned on top of the tackless strip 56 to ensure the applied force is transmitted horizontally during a carpet stretching stroke to prevent the tackless strip 56 from being lifted from the floor 57.

As can be seen the carpet engaging head 29 is fully retracted in FIG. 9 and corresponds to the position of FIGS. 4 and 8. On depression of the push button 39 the carpet engaging head 29 will initially be lowered and as the extension continues the angled prongs 51 will engage the carpet backing 62 through pile 63 and continue until fully extended. Of course a carpet installer will usually be holding handle 16 while depressing push button 39. Alternatively the carpet installer can lock the push button 39 in its fully depressed position and walk on the carpet at remote locations from the carpet engaging head 29 in order to assist distribution of tension.

FIG. 10 illustrates the carpet engaging head at an intermediate point in its extension and FIG. 11 illustrates the carpet engaging head 29 fully extended and elevated. The push button 39 has been released and retraction of the carpet engaging head has been initiated.

The carpet is engaged by pins 59 and has been stretched and is engaged on the tackless strip and has been stretched to the manufacturers specifications. The carpet installer then slides the carpet stretcher 10 along the wall 55 while maintaining the face plate behind the tackless strip 56. This stretching process is repeated at spaced locations along the wall 55 and is accomplished quickly and easily.

Figure 12:
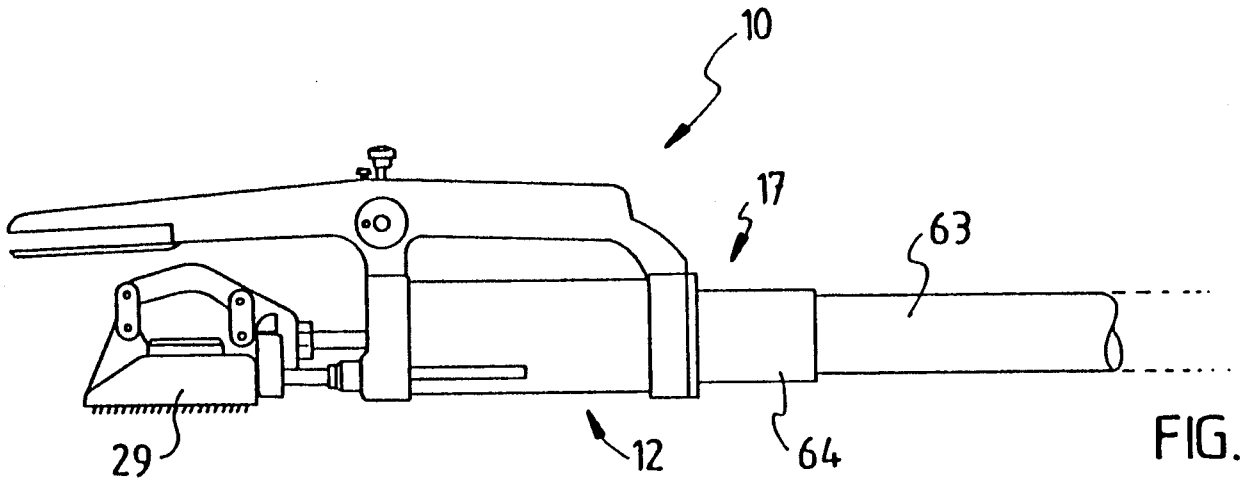
FIGS. 12 and 13 illustrate two alternative applications of the carpet stretcher of the present invention.

Referring to FIG. 12 there is illustrated a carpet stretcher 10 according to the present invention and being of the same basic configuration as the carpet stretcher of FIGS. 1 to 11. Like numerals illustrate like features. The face plate of the previous embodiments has been removed and a telescopic extension 63 (only one end of which is shown) has been attached to the handle end 17. The other end of the telescopic extension in use would abut against a stationary support such as a wall to enable carpet to be pushed toward and into engagement with a tackless strip. It will be realised that although telescopic extensions are known in the prior art the provision of an attachment means 64 at the handle end 17 of the carpet stretcher 10 increases the versatility of the carpet stretcher. In some applications it may be desirable to use a telescopic extension in preference to say a face plate.

Figure 13:
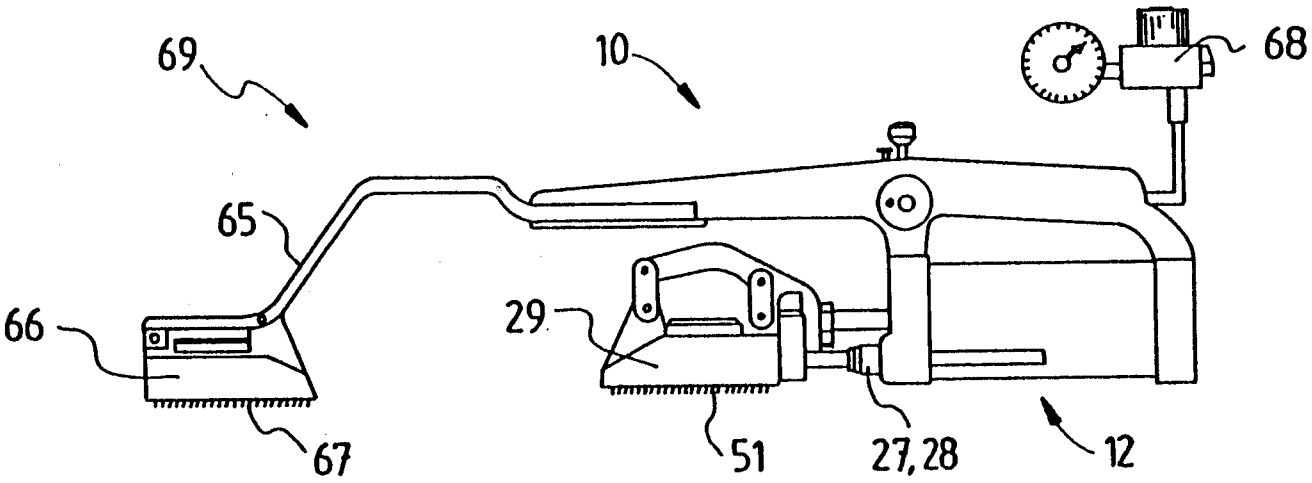

Referring to FIG. 13 two further advantageous applications of the present invention are considered, first a sub-frame attachment 65 is shown connected to a carpet stretcher 10 according to the invention. The sub-frame attachment 65 has been connected in place of the face plate of the FIGS. 1 to 11 embodiments. A fixed carpet engaging head 66 is mounted to the subframe and its prongs 67 are in the same plane as the prongs 51 of carpet engaging head 29 when it is lowered to its extension position (as illustrated). The carpet stretcher configured in this way can now be used to join spaced edges of carpet and the amount of stretch can be controlled by adjusting the extension of carpet engaging head 29 via stops 27 and 28 and/or the applied pressure by adjusting pressure regulator 68. The pressure regulator is located intermediate a compressor (not shown) and the carpet stretcher.

It will of course be appreciated that a pressure regulator and pressure gauge could be incorporated into the carpet stretcher frame 11 if so desired. The second advantageous application referenced with regard to FIG. 13 is as a test rig for determining whether a carpet is adequately and properly stretched. The test rig 69 can be positioned at any location on a carpet where the tension or stress in the carpet is to be measured. The push button 39 is then depressed and locked in the fully depressed position and the pressure regulator is adjusted to gradually increase the pressure within the pneumatic cylinder assembly 12 to drive the carpet engaging head 29 toward head 66. It will be realised that the head 29 is working against the existing tension in the carpet and as the pressure is increased the carpet between the heads will begin to "ruck". At the first sign of rucking, the pressure reading will give an indication of carpet tension.

It will be apparent that the test rig provides a very useful and advantageous aid in measuring and monitoring carpet tension but it will also be realised that the carpet stretcher 10 can be used with other accessories in useful applications.

It will be further realised that many modifications and variations may be made to the present invention without departing from the broad ambit and scope of the invention as herein set forth and claimed in the appended claims.

We claim:

1. A carpet stretcher comprising a retractable carpet engaging head, a pneumatic cylinder assembly for extending and retracting the head and control means for controlling flow of air through the cylinder assembly, the cylinder assembly having a cylinder, a movable piston within the cylinder and a piston rod connected to the piston, the piston rod having a protruding portion extending from the cylinder, connecting means providing a flexible connection between the carpet engaging head and the protruding portion of the piston rod such that on operation of the control means to retract the carpet engaging head, the carpet engaging head automatically moves to an elevated position relative to a carpet being stretched, the connecting means including an arm having opposed ends, one end of the arm being connected to the piston rod and the other end of the arm being connected to the carpet engaging head via a pivotal linkage, a push plate engageable by the arm to move in concert with the arm and the carpet engaging head along only part of the travel of the carpet engaging head such that there is lost motion between the push plate and the carpet engaging head to effect elevation or lowering of the carpet engaging head, and a frame on which the cylinder assembly is mounted, the frame having a pair of spaced guideways, the push plate being coupled to the frame via a pair of spaced guide rods slidingly moveable in the guideways in response to engagement of the push plate by the arm.

2. A carpet stretcher according to claim 1 wherein the cylinder assembly is a double acting pneumatic cylinder assembly having a drive chamber remote from the carpet engaging head and a return chamber between the carpet engaging head and the drive chamber, said drive and return chambers being located on respective opposite sides of the moveable piston, and conduit means through which air ca flow into or out of the respective chambers in response to operation of the control means, said control means including a manually operable valve for directing air into or out of the chambers through said conduit means and a pressure regulator, the pressure regulator being adapted to vent air from the return chamber when the pressure in the return chamber exceeds a predetermined pressure.

3. A carpet stretcher according to claim 2 further including accessory attachment means and an accessory selected from the following:

(a) an extension having one end secured to the attachment means and when operatively so secured, has a free end remote from the attachment means whereby the carpet engaging head can retract in a direction away from the free end of said extension;

(b) an extension having one end secured to the attachment means and when operatively so secured, has a free end remote from the attachment means whereby the carpet engaging head can retract in a direction toward the free end of said extension, and (c) an auxiliary carpet engaging head secured to the attachment means, and when so secured to in use, act in opposition to or in unison with the retractable carpet engaging head.

4. A carpet stretcher according to claim 2 wherein the connecting means includes an arm having opposed ends, one end of the arm being connected to the piston rod and the other end of the arm being connected to the carpet engaging head via a pivotal linkage, a push plate engageable by the arm to move in concert with the arm and the carpet engaging head along part only of the travel of the carpet engaging head such that there is lost motion between the push plate and the carpet engaging head to effect elevation or lowering of the carpet engaging head, the carpet stretcher including a frame on which the cylinder assembly is mounted, the frame having spaced guideways, the push plate being coupled to the frame via spaced guide rods slidingly movable in the guideways in response to engagement of the push plate by the arm.

5. A carpet stretcher according to claim 1 further including accessory attachment means and an accessory selected from the following:

(a) an extension having one end secured to the attachment means and when operatively so secured, has a free end remote from the attachment means whereby the carpet engaging head can retract in a direction away from the free end of said extension;

(b) an extension having one end secured to the attachment means and when operatively so secured, has a free end remote from the attachment means whereby the carpet engaging head can retract in a direction toward the free end of said extension, and (c) an auxiliary carpet engaging head secured to the attachment means, and when so secured to in use, act in opposition to or in unison with the retractable carpet engaging head.

6. A carpet stretcher according to claim 1 wherein the control means comprises a manually operable valve positioned to facilitate single handed operation of the carpet stretcher, biasing means urging the valve to a closed position thereby preventing flow of air to the cylinder assembly, the valve being movable to different positions to initiate different responses from the carpet engaging head, the positions including a head extension position to initiate an extension of the carpet engaging head, a head retraction position to initiate retraction of the carpet engaging head, and a neutral position to stop motion of the head.

7. A carpet stretcher according to claim 1 including an adjustable stop for adjustably limiting the length of travel of said push plate and thereby adjustably limiting the travel of said carpet engaging head.

8. A carpet stretcher comprising a retractable carpet engaging head, a double acting pneumatic cylinder assembly for extending and retracting the head and control means for controlling flow of air through the cylinder assembly, the cylinder assembly having a cylinder, a movable piston within the cylinder, a piston rod connected to the piston, the piston rod having a protruding portion extending from the cylinder, a drive chamber remote from the carpet engaging head and a return chamber between the carpet engaging head and the drive chamber, said drive and return chambers being located on respective opposite sides of the moveable piston, and conduit means through which air can flow into or out of the respective chambers in response to operation of the control means, said control means including a manually operable valve for directing air into or out of the chambers through said conduit means and a pressure regulator, the pressure regulator being adapted to vent air from the return chamber when the pressure in the return chamber exceeds a predetermined pressure, connecting means providing a flexible connection between the carpet engaging head and the protruding portion of the piston rod such that on operation of the control means to retract the carpet engaging head, the carpet engaging head automatically moves to an elevated position relative to a carpet being stretched, the connecting means includes an arm having opposed ends, one end of the arm being connected to the piston rod and the other end of the arm being connected to the carpet engaging head via a pivotal linkage, a push plate engageable by the arm to move in concert with the arm and the carpet engaging head along only part of the travel of the carpet engaging head such that there is lost motion between the push plate and the carpet engaging head to effect elevation or lowering of the carpet engaging head, the carpet stretcher including a frame on which the cylinder assembly is mounted, the frame having a spaced guideway, the push plate being coupled to the frame via a spaced guide rod slidingly moveable in the guideway in response to engagement of the push plate by the arm.

9. A carpet stretcher comprising a retractable carpet engaging head, a pneumatic cylinder assembly for extending and retracting the head and control means for controlling flow of air through the cylinder assembly, the cylinder assembly having a cylinder, a movable piston within the cylinder and a piston rod connected to the piston, the piston rod having a protruding portion extending from the cylinder, connecting means providing a flexible connection between the carpet engaging head and the protruding portion of the piston rod such that on operation of the control means to retract the carpet engaging head, the carpet engaging head automatically moves to an elevated position relative to a carpet being stretched, a guide rod slidingly moveable in a fixed guideway such that the guide rod moves in concert with said carpet engaging head as the carpet engaging head extends, an adjustable stop for adjustably limiting the travel of said guide rod in said guideway and thereby adjustably limiting the length of travel of said carpet engaging head.

10. A carpet stretcher comprising a retractable carpet engaging head, a double acting pneumatic cylinder assembly for extending and retracting the head and control means for controlling flow of air through the cylinder assembly, the cylinder assembly having a cylinder, a movable piston within the cylinder, a piston rod connected to the piston, the piston rod having a protruding portion extending from the cylinder, a drive chamber remote from the carpet engaging head and a return chamber between the carpet engaging head and the drive chamber, said drive and return chambers being located on respective opposite sides of the moveable piston, and conduit means through which air can flow into or out of the respective chambers in response to operation of the control means, said control means including a manually operable valve for directing air into or out of the chambers through said conduit means and a pressure regulator, the pressure regulator being adapted to vent air from the return chamber when the pressure in the return chamber exceeds a predetermined pressure, connecting means providing a flexible connection between the carpet engaging head and the protruding portion of the piston rod such that on operation of the control means to retract the carpet engaging head, the carpet engaging head automatically moves to an elevated position relative to a carpet being stretched, a guide rod slidingly moveable in a fixed guideway such that the guide rod moves in concert with said carpet engaging head as the carpet engaging head extends, an adjustable stop for adjustably limiting the travel of said guide rod in said guideway and thereby adjustably limiting the length of travel of said carpet engaging head.

11. A carpet stretcher comprising a retractable carpet engaging head, a cylinder assembly for extending and retracting the head and control means for controlling flow of air through the cylinder assembly, the cylinder assembly having a cylinder, a moveable piston within the cylinder and a piston rod connected to the piston, the piston having a protruding portion extending from the cylinder, connection means connecting the carpet engaging head to the protruding portion of the piston rod and a guide rod slidably moveable in a fixed guideway as the carpet engaging head extends, and an adjustable stop for adjustably limiting the length of travel of said carpet engaging head as the carpet engaging head extends.

* * * * *